US011220874B2

(12) United States Patent
Charles et al.

(10) Patent No.: US 11,220,874 B2
(45) Date of Patent: Jan. 11, 2022

(54) FLOW MEASUREMENT CHOKE VALVE SYSTEM

(71) Applicant: ADS SERVICES LLC, Midland, TX (US)

(72) Inventors: Scott Charles, Houston, TX (US); Anand Parthasarathy, Cypress, TX (US)

(73) Assignee: ADS SERVICES LLC, Midland, TX (US)

( * ) Notice: Subject to any disclaimer, the term of this patent is extended or adjusted under 35 U.S.C. 154(b) by 0 days.

(21) Appl. No.: 16/863,588

(22) Filed: Apr. 30, 2020

(65) Prior Publication Data

US 2021/0340828 A1 Nov. 4, 2021

(51) Int. Cl.
*E21B 21/10* (2006.01)
*E21B 34/02* (2006.01)

(52) U.S. Cl.
CPC ..... *E21B 21/106* (2013.01); *E21B 34/025* (2020.05)

(58) Field of Classification Search
CPC ..... E21B 21/106; E21B 34/02; E21B 34/025
See application file for complete search history.

(56) References Cited

U.S. PATENT DOCUMENTS

| | | | | |
|---|---|---|---|---|
| 9,988,866 | B2 * | 6/2018 | Cotten | E21B 21/106 |
| 10,227,838 | B2 * | 3/2019 | Dillard | G01F 1/40 |
| 10,895,121 | B2 * | 1/2021 | Manum | E21B 21/08 |
| 10,961,816 | B1 * | 3/2021 | Church, Jr. | E21B 34/025 |
| 2012/0330466 | A1 * | 12/2012 | Rodger | E21B 34/02 700/282 |
| 2014/0090888 | A1 * | 4/2014 | Smith | E21B 34/02 175/38 |
| 2020/0040677 | A1 * | 2/2020 | Spencer | E21B 47/06 |
| 2020/0208479 | A1 * | 7/2020 | Parthasarathy | E21B 21/08 |
| 2020/0318746 | A1 * | 10/2020 | Parthasarathy | F16K 1/54 |

* cited by examiner

*Primary Examiner* — Matthew R Buck

(57) ABSTRACT

A drilling system includes a choke valve system in fluid communication with a wellbore via a fluid return line. The choke valve system is configured to receive a return fluid from the wellbore. The choke valve system includes a choke valve through which the return fluid flows and a valve position sensor configured to determine a position of the choke valve. The drilling system further includes a controller in signal communication with the valve position sensor. The controller is programmed to determine a flow rate of the return fluid through the fluid return line based on the determined position of the choke valve. The controller is further programmed to adjust the position of the choke valve in response to the determined flow rate of the return fluid.

17 Claims, 11 Drawing Sheets

FLOW MEASUREMENT CHOKE VALVE SYSTEM

BACKGROUND

1. Technical Field

This disclosure relates generally to choke valve flow measurement in well drilling applications and, more particularly, to valve position-based choke valve flow measurement.

2. Background Information

Subterranean wells (subsea or land based) are typically created by drilling a hole into the earth with a drilling rig that rotates a drill string that includes a hollow drill pipe and a drill bit attached to an end of the drill pipe. After the hole is drilled, casing sections are inserted into the hole to provide structural integrity to the newly drilled wellbore, and in some instances to isolate potentially dangerous high pressure zones from each other and from the surface. This process may be repeated several times (e.g., two to five times) at increasingly smaller bore diameters to create a well at a desired depth.

The drill bit is configured to cut into whatever material (e.g., rock) is encountered during the drilling process. To facilitate the drilling process, a drilling fluid (often referred to as "mud") is typically pumped down the inside of the drill pipe and exits at the drill bit. The drilling fluid may be a fluid, or may be a mixture of fluids, solids and chemicals that is tailored to provide the correct physical and chemical characteristics required to safely drill the well; e.g., cool the drill bit, lift cuttings to the surface, prevent destabilization of the rock in the wellbore walls, overcome the pressure of fluids inside the rock so that these fluids do not enter the wellbore, etc. The debris (often referred to as "cuttings") generated by the drilling process is swept up by the drilling fluid as it circulates back to surface outside the drill pipe. The drilling fluid and debris is subsequently processed to separate the cuttings and return the circulating drilling fluid to the drilling process. A pumping system (typically referred to as a "mud pump") is typically used to circulate the drilling fluid.

During the drilling process, the fluids located at the bottom of the well are said to be at a "bottom hole" pressure ($P_{BH}$), which pressure is a function of the hydrostatic pressure within the well and may also be a function of annular friction pressure during a dynamic condition. For a variety of reasons, it is desirable to maintain a substantially constant $P_{BH}$ that is higher than the fluid pressure in the local rock formation (i.e., the formation pressure). Some wells utilize a "managed pressure drilling" (MPD) system during the normal course of drilling that is configured to maintain a substantially constant $P_{BH}$ during drilling. By manipulating topside located chokes and pumps, MPD provides an improved means (relative to conventional drilling control techniques) of managing wellbore pressure and counteracting pressure disturbances that may occur.

In order to achieve the substantially constant $P_{BH}$, it may be necessary to measure a flow rate of the fluid which is returned from the wellbore to the drilling system. Measurement of the return fluid flow rate may conventionally be measured using a Coriolis flowmeter. However, such flowmeters are expensive and may have pressure limitation which are not suitable for some drilling equipment applications. Further, the inclusion of Coriolis flowmeters in a choke manifold may increase the size of the manifold, thereby occupying an additional amount of limited available rig space. Accordingly, what is needed are systems and methods for addressing one or more of the above-discussed concerns.

SUMMARY

It should be understood that any or all of the features or embodiments described herein can be used or combined in any combination with each and every other feature or embodiment described herein unless expressly noted otherwise.

According to an aspect of the present disclosure, a drilling system includes a choke valve system in fluid communication with a wellbore via a fluid return line. The choke valve system is configured to receive a return fluid from the wellbore. The choke valve system includes a choke valve through which the return fluid flows and a valve position sensor configured to determine a position of the choke valve. The drilling system further includes a controller in signal communication with the valve position sensor. The controller is programmed to determine a flow rate of the return fluid through the fluid return line based on the determined position of the choke valve. The controller is further programmed to adjust the position of the choke valve in response to the determined flow rate of the return fluid.

In any of the aspects or embodiments described above and herein, the choke valve includes a body having an internal chamber, an inlet flow passage that extends between an exterior of the body and the internal chamber, and an outlet flow passage that extends between the exterior of the body and the internal chamber. The choke valve further includes a seat having a seat orifice with an area. The seat is positioned at an end of the outlet flow passage contiguous with the internal chamber. The choke valve further includes a gate having a gate shaft and a gate body affixed to one end of the gate shaft. The gate is linearly translatable within the body between a fully open position and a fully closed position. In the fully closed position the gate body is engaged with the seat orifice. In the fully open position a choke minimum passage area is defined between the gate body and the seat orifice. The choke minimum passage area is at least 30 percent of the area of the seat orifice.

According to another aspect of the present disclosure, a drilling system includes a drill assembly in fluid communication with a fluid supply line and a wellbore. The drill assembly is configured to receive a first fluid from the fluid supply line and inject the first fluid into the wellbore. The drilling system further includes a choke manifold including a choke valve system in fluid communication with the wellbore via a fluid return line. The choke valve system is configured to receive a second fluid from the wellbore. The choke valve system includes a choke valve through which the second fluid flows and a valve position sensor configured to determine a position of the choke valve. The drilling system further includes a flow sensor in fluid communication with the fluid supply line and configured to determine a first flow rate of the first fluid through the fluid supply line. The drilling system further includes a controller in signal communication with the valve position sensor and the flow sensor. The controller is programmed to determine a second flow rate of the second fluid through the fluid return line based on the position of the choke valve, detect a kick or a loss of fluid in the wellbore based on the first flow rate and the second flow rate, and adjust the position of the choke valve in response to the detected kick or loss of fluid in the wellbore.

In any of the aspects or embodiments described above and herein, the choke manifold may further include at least one pressure sensor.

In any of the aspects or embodiments described above and herein, the at least one pressure sensor may include a first pressure sensor upstream of the choke valve and a second pressure sensor downstream of the choke valve.

In any of the aspects or embodiments described above and herein, the drill system may further include a first density sensor upstream of the choke valve and a second density sensor downstream of the choke valve.

In any of the aspects or embodiments described above and herein, the controller may be further programmed to maintain the position of the choke valve in a position range of between 30 percent and 70 percent of a total position range of the choke valve while the first fluid is injected into the wellbore.

In any of the aspects or embodiments described above and herein, the choke valve may include a body having an internal chamber, an inlet flow passage that extends between an exterior of the body and the internal chamber, and an outlet flow passage that extends between the exterior of the body and the internal chamber. The choke valve may further include a seat having a seat orifice with an area. The seat is positioned at an end of the outlet flow passage contiguous with the internal chamber. The choke valve may further include a gate having a gate shaft and a gate body affixed to one end of the gate shaft. The gate is linearly translatable within the body between a fully open position and a fully closed position. In the fully closed position the gate body is engaged with the seat orifice. In the fully open position a choke minimum passage area is defined between the gate body and the seat orifice. The choke minimum passage area is at least 30 percent of the area of the seat orifice.

In any of the aspects or embodiments described above and herein, the choke minimum passage area may be between 30 percent and 70 percent of the seat orifice area.

In any of the aspects or embodiments described above and herein, the choke valve manifold may further include a second choke valve system including a second choke valve through which the second fluid flows.

According to another aspect of the present disclosure, a method for detecting a kick or a loss of fluid in the wellbore may include injecting a first fluid into a wellbore with a drill assembly in fluid communication with a fluid supply line and the wellbore. The method may further include receiving a second fluid from the wellbore with a choke valve system in fluid communication with the wellbore via a fluid return line. The choke valve system includes a choke valve through which the second fluid flows. The method may further include determining a position of the choke valve with a valve position sensor of the choke valve system. The method may further include determining a first flow rate of the first fluid through the fluid supply line with a flow sensor in fluid communication with the fluid supply line. The method may further include determining a second flow rate of the second fluid through the fluid return lien based on the position of the choke valve. The method may further include detecting a kick or a loss of fluid in the wellbore based on the first flow rate and the second flow rate. The method may further include adjusting the position of the choke valve in response to the detected kick or loss of fluid in the wellbore.

In any of the aspects or embodiments described above and herein, the method may further include determining a pressure of the second fluid with at least one pressure sensor of the choke manifold.

In any of the aspects or embodiments described above and herein, the at least one pressure sensor may include a first pressure sensor upstream of the choke valve and a second pressure sensor downstream of the choke valve.

In any of the aspects or embodiments described above and herein, the method may further include determining a first density of the second fluid with a first density sensor upstream of the choke valve and determining a second density of the second fluid with a second density sensor downstream of the choke valve.

In any of the aspects or embodiments described above and herein, the second fluid may be a multi-phase fluid.

In any of the aspects or embodiments described above and herein, the method may further include maintaining the position of the choke valve in a position range of between 30 percent and 70 percent of a total position range of the choke valve while the first fluid is injected into the wellbore.

In any of the aspects or embodiments described above and herein, the choke valve may include a body having an internal chamber, an inlet flow passage that extends between an exterior of the body and the internal chamber, and an outlet flow passage that extends between the exterior of the body and the internal chamber. The choke valve may further include a seat having a seat orifice with an area. The seat is positioned at an end of the outlet flow passage contiguous with the internal chamber. The choke valve may further include a gate having a gate shaft and a gate body affixed to one end of the gate shaft. The gate is linearly translatable within the body between a fully open position and a fully closed position. In the fully closed position the gate body is engaged with the seat orifice. In the fully open position a choke minimum passage area is defined between the gate body and the seat orifice. The choke minimum passage area is at least 30 percent of the area of the seat orifice. In the fully open position a choke minimum passage area is defined between the gate body and the seat orifice. The choke minimum passage area is at least 30 percent of the seat orifice area.

In any of the aspects or embodiments described above and herein, the method may further include maintaining the position of the choke valve in a position range of between 0 percent and 60 percent of a total position range of the choke valve while the first fluid is injected into the wellbore.

In any of the aspects or embodiments described above and herein, determining the second flow rate of the second fluid through the fluid return lien based on the position of the choke valve may include referencing a flow coefficient lookup table including a flow coefficient valve corresponding to the determined position of the choke valve.

In any of the aspects or embodiments described above and herein, the method may further include calculating an updated flow coefficient value for the determined position of the choke valve and replacing the flow coefficient valve of the flow coefficient lookup table with the updated flow coefficient value.

The present disclosure, and all its aspects, embodiments and advantages associated therewith will become more readily apparent in view of the detailed description provided below, including the accompanying drawings.

DETAILED DESCRIPTION

Figure 1:
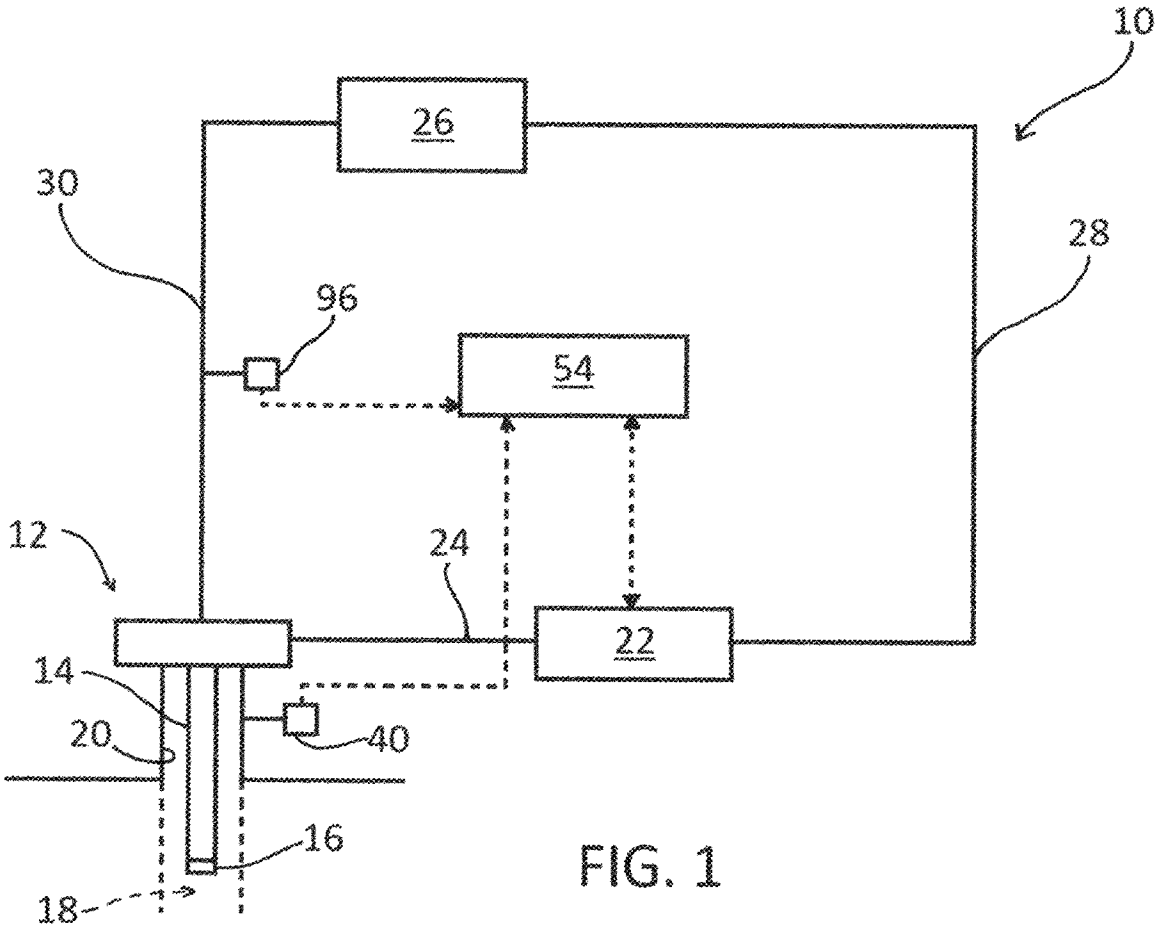
FIG. 1 illustrates a drilling system, in accordance with one or more embodiments of the present disclosure.

It is noted that various connections are set forth between elements in the following description and in the drawings. It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities. It is further noted that various method or process steps for embodiments of the present disclosure are described in the following description and drawings. The description may present the method and/or process steps as a particular sequence. However, to the extent that the method or process does not rely on the particular order of steps set forth herein, the method or process should not be limited to the particular sequence of steps described. As a person of skill in the art will recognize, other sequences of steps may be possible. Therefore, the particular order of the steps set forth in the description should not be construed as a limitation.

Figure 10:
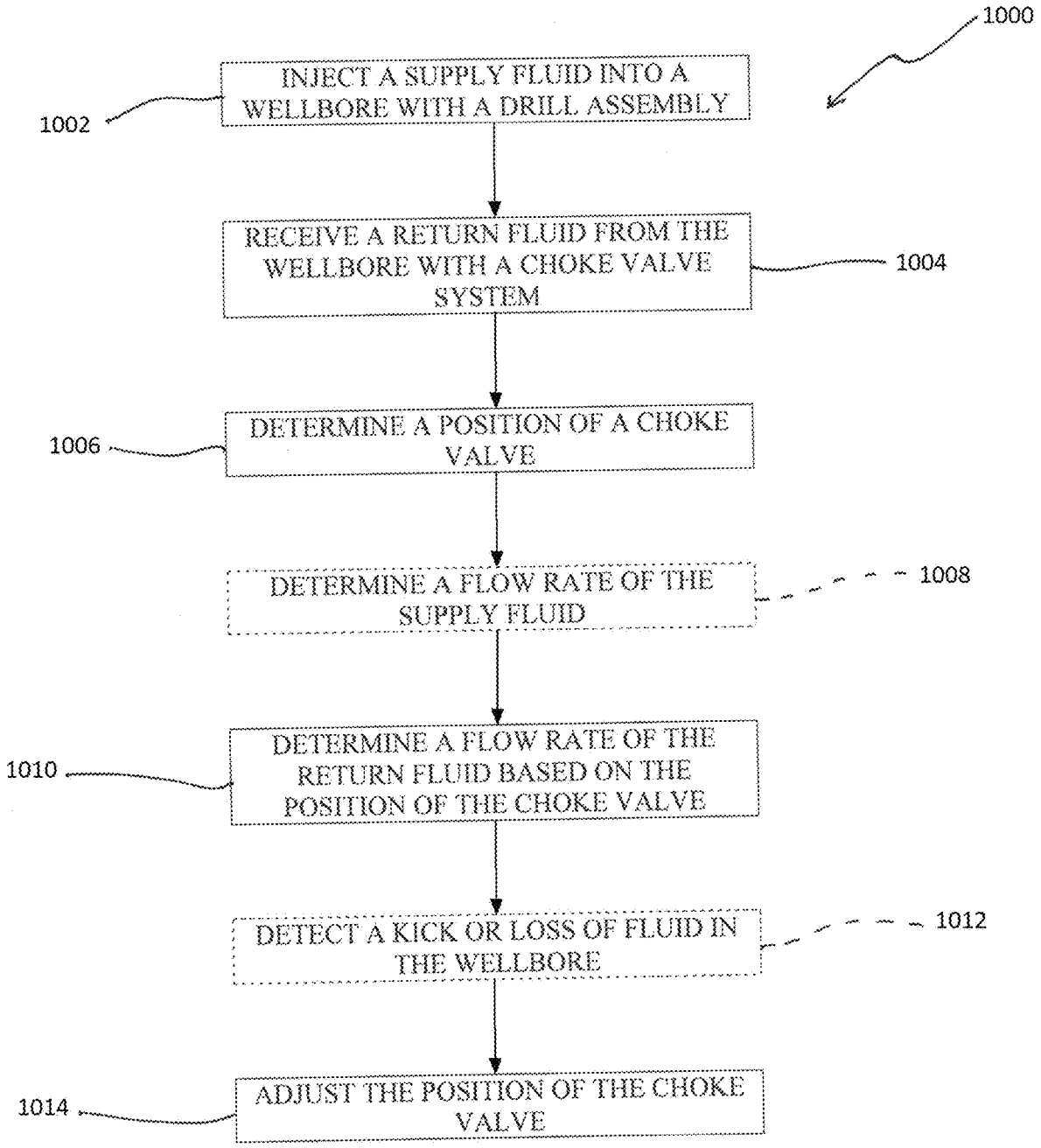
FIG. 10 illustrates a flow chart for a method for detecting a kick or a loss of fluid in a wellbore, in accordance with one or more embodiments of the present disclosure.

Referring to FIGS. 1 and 10, a simplified diagram of a drilling system 10 is illustrated. The drilling system 10 includes a drill assembly 12 having a drill string 14 and a drill bit 16 which are configured to extend downhole into a wellbore 18. The drill assembly 12 further includes a riser 20 extending from the drill assembly 12 to the wellbore 18 and surrounding the drill string 14. The drilling system 10 includes a choke manifold 22 in fluid communication with the wellbore 18 and the riser 20 via a fluid return line 24. The choke manifold 22 receives a return fluid from the wellbore 18 via the riser 20 and the fluid return line 24 and supplies the return fluid to at least one mud pump 26 via a fluid line 28. The mud pump 26 provides a supply fluid to the drill assembly 12 via a fluid supply line 30 for injection into the wellbore 18 (Step 1002 of Method 1000). As a person of skill in the art will recognize, a drilling system, such as the drilling system 10, may include one or more additional components not shown such as, for example, mud-gas separators, mud tanks, various additional pumps, flow control valves, and fluid lines, etc.

Figure 2:
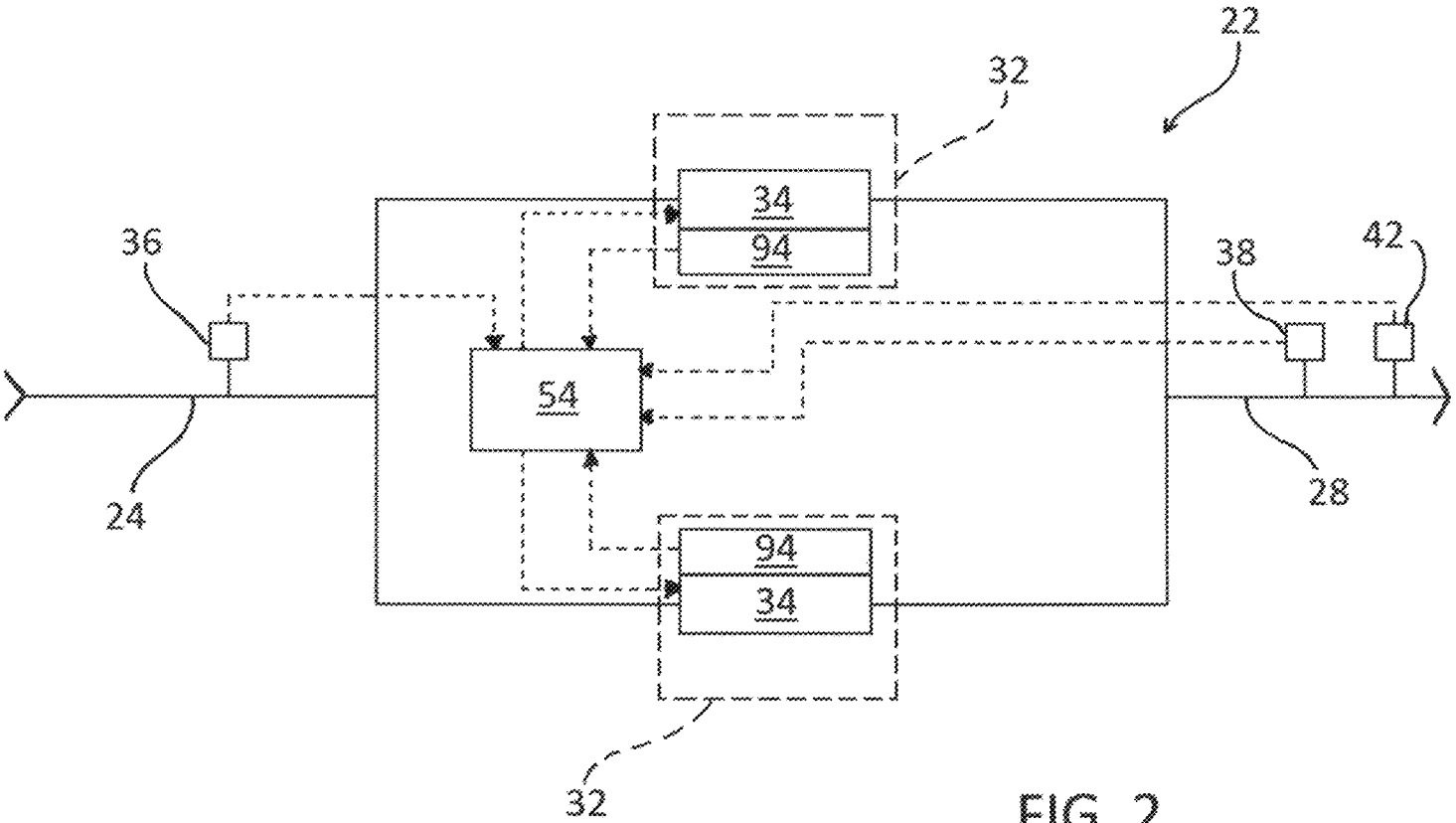
FIG. 2 illustrates a choke manifold of the drilling system of FIG. 1, in accordance with one or more embodiments of the present disclosure.

Referring to FIGS. 1, 2, and 10, the choke manifold 22 includes one or more choke valve systems 32 configured to receive and control the return fluid from the wellbore 18 (Step 1004 of Method 1000). For example, as shown in FIG. 2, the choke manifold 22 includes two parallel choke valve systems 32. Each choke valve system 32 includes an adjustable choke valve 34 configured to control the flow of return fluid through the choke manifold 22. The fluid pressure in the wellbore 18 and drill assembly 12 may, therefore, be controlled by adjusting the positions of the choke valves 34 to control back pressure of the return fluid in the fluid return line 24.

In various embodiments the choke manifold 22 may include at least one pressure sensor 36, 38 for measuring a pressure of the return fluid. A first pressure sensor 36 may be disposed upstream of the choke valves 34 while a second pressure sensor 38 may be disposed downstream of the choke valves 34. Accordingly, a differential pressure DP of the return fluid across the choke system 32 may be determined by comparing the return fluid pressure at the first pressure sensor 36 to the fluid pressure at the second pressure sensor 38.

In various embodiments, the drilling system 10 may include at least one density sensor 40, 42 for measuring a density of return fluid. A first density sensor 38 may be disposed in the riser 20 or the fluid return line 24 upstream of the choke valves 34. A second density sensor 40 may be disposed in the fluid line 28 downstream of the choke valves 34. By measuring the density of the return fluid upstream and downstream of the choke valves 34 with the respective first density sensor 38 and second density sensor 40, specific gravities of the return fluid upstream and downstream of the choke valves 34 may be determined.

Figure 3:
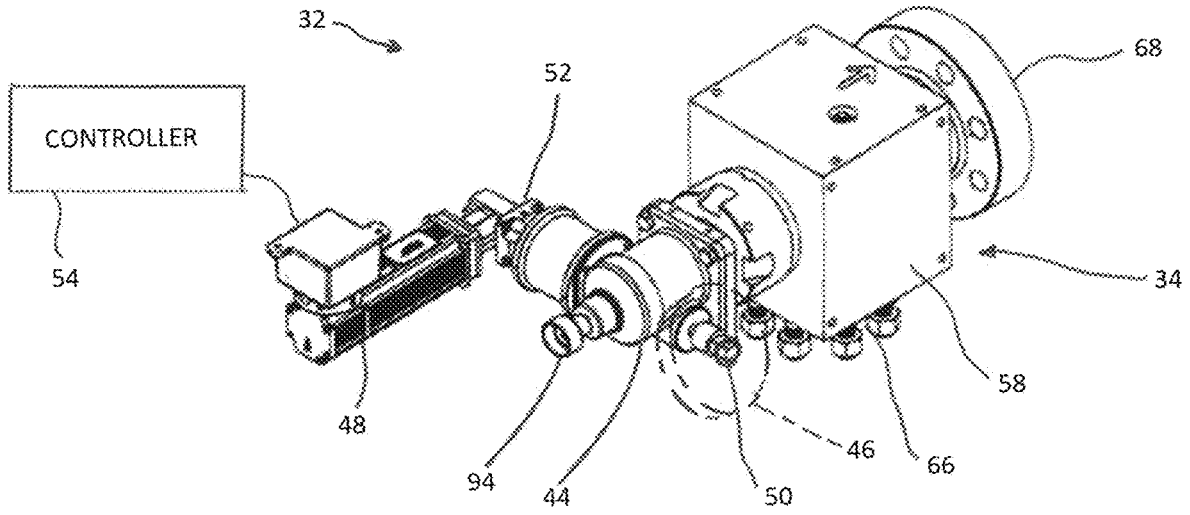
FIG. 3 illustrates a perspective view of a choke valve system, in accordance with one or more embodiments of the present disclosure.
Figure 4:
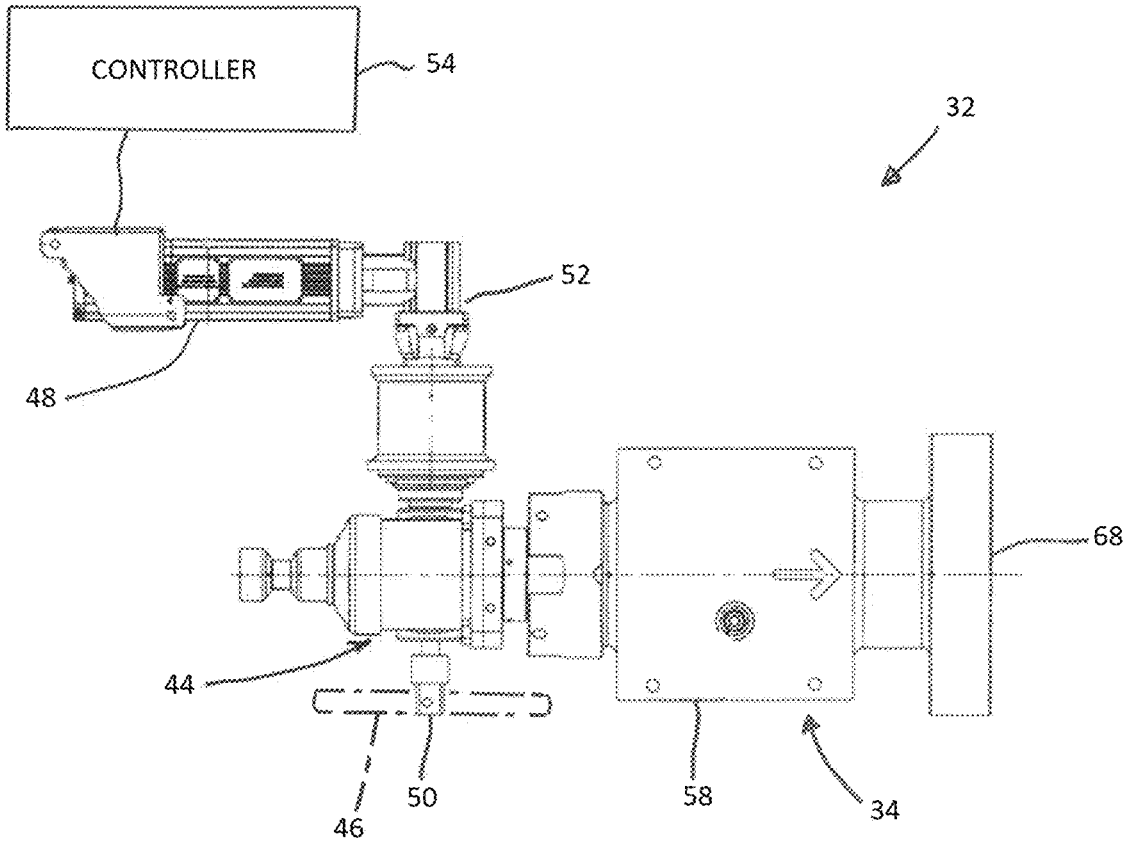
FIG. 4 illustrates a planar view of the choke valve system of FIG. 3, in accordance with one or more embodiments of the present disclosure.

Referring to FIGS. 2-4, and 10, the choke valve system 32 includes the choke valve 34 and a worm gear drive 44. The choke valve 34 may be a manually actuated valve (e.g., actuable via a hand wheel 46), or the choke valve 34 may be powered by a motor 48, or both. As shown in FIGS. 3 and 4, the exemplary choke valve system 32 is powered by an electric motor 48 and includes a hand wheel 46 (shown in phantom) for manual operation. For those choke valve system 32 embodiments which include a motor 48, the motor 48 may be an electric motor, a hydraulic motor, a pneumatic motor, or the like. However, it should be understood that the present disclosure is not limited to any particular type of motor 48. The motor 48 may be coupled to an input shaft 50 of the worm gear drive 44 either directly or indirectly via a gearbox 52.

In various embodiments wherein the choke valve 34 is powered by the motor 48, the choke valve system 32 may include a controller 54 (e.g., including a programmable drive) configured to control the operation of the motor 48. For example, if the choke valve 34 is powered by an electric motor, the choke valve system 32 may include a controller 54 that includes any type of computing device, computational circuit, or any type of process or processing circuit capable of executing a series of instructions that are stored in memory, including instructions for accomplishing tasks associated with the methodologies described herein. For example, the controller 54 may include multiple processors and/or multicore CPUs and may include any type of processor, such as a microprocessor, digital signal processor, co-processors, a micro-controller, a microcomputer, a central processing unit, a field programmable gate array, a programmable logic device, a state machine, logic circuitry, analog circuitry, digital circuitry, etc., and any combination thereof. The instructions stored in memory may represent one or more algorithms for controlling the choke valve 34, the motor 48, etc., and the stored instructions are not limited to any particular form (e.g., program files, system data, buffers, drivers, utilities, system programs, etc.) provided they can be executed by the controller 54. The memory may be a non-transitory computer readable storage medium configured to store instructions that when executed by one or more processors, cause the one or more processors to perform or cause the performance of certain functions. The memory may be a single memory device or a plurality of memory devices. A memory device may include a storage area network, network attached storage, as well a disk drive, a read-only memory, random access memory, volatile memory, non-volatile memory, static memory, dynamic memory, flash memory, cache memory, and/or any device that stores digital information. A person of skill in the art will recognize, based on a review of this disclosure, that the implementation of the controller 54 may be achieved via the use of hardware, software, firmware, or any combination thereof. The controller 54 may include one or more input devices (e.g., a keyboard, a touch screen, communication input ports, terminals, wireless communication devices, sensors, etc.) and/or one or more output devices (a monitor, data readouts, communication output ports, terminals, wireless communication devices, sensors, etc.) that enable signals and/or communications to be sent to and/or provided from the controller 54. The controller 54 may be in signal communication with one or more of the sensors 36, 38, 40, 42.

The choke valve 34 may be coupled directly or indirectly to an output shaft 56 of the worm gear drive 44. Rotation of the input shaft 50 of the worm gear drive 44 in a first rotational direction (e.g., clockwise) causes linear translation of the output shaft 56 of the worm gear drive 44 (and choke gate 62 as described below) in a first linear direction. Rotation of the input shaft 50 of the worm gear drive 44 in a second rotational direction (e.g., counter clockwise) causes linear translation of the output shaft 56 of the worm gear drive 44 (and gate 62) in a second linear direction (i.e., opposite the first linear direction). The worm gear drive 44 provides torque multiplication and speed reduction, and also resists back driving of the choke valve 34 in communication with the output shaft 56 of the worm gear drive 44. The gearbox 52 is also configured to provide torque multiplication and speed reduction.

Figure 6A:
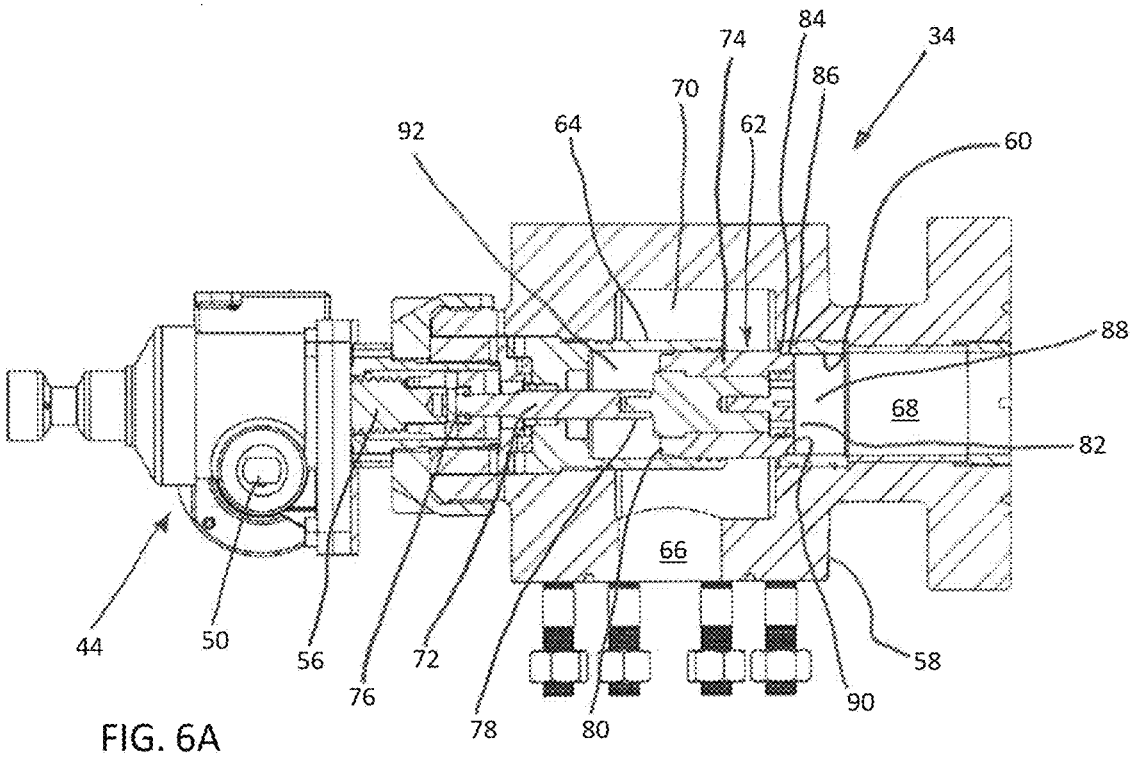
FIG. 6A illustrates a partially sectioned choke valve showing the choke valve in a fully closed position, in accordance with one or more embodiments of the present disclosure.
Figure 6B:
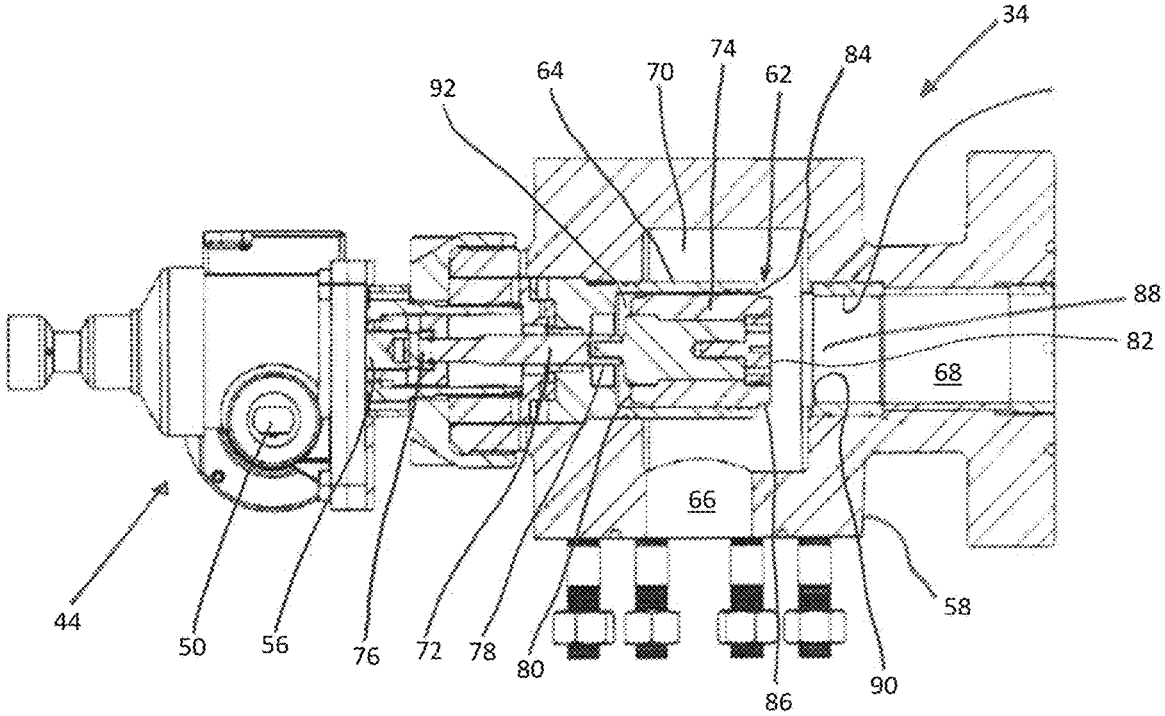
FIG. 6B illustrates the partially section choked valve of FIG. 6A, shown in a fully open position, in accordance with one or more embodiments of the present disclosure.

The choke valve system 32 includes a valve position sensor 94 configured to determine a position of the choke valve 34 relative to a first position (i.e., a "fully closed" position) where zero fluid flow (0% flow) is permitted through the choke valve 34 and a second position (i.e., a "fully open" position) where a maximum fluid flow (100% flow) is permitted between through the choke valve 34 (Step 1006 of Method 1000). For example, as will be discussed in further detail, the valve position sensor 94 may measure a linear position of a gate of the choke valve 34 (see, e.g., FIGS. 6A and 6B illustrating the gate 62 of the choke valve 57) which is linearly translatable between a "fully closed" position (i.e., 0% open), a "fully open" position (i.e., 0% open), and a continuum of positions there between (e.g., 70% open, 40% open, 10% open, etc.). The valve position sensor 94 may be in signal communication with the controller 54 and may provide the measured valve position of the choke valve 34 to the controller 54.

Figure 5:
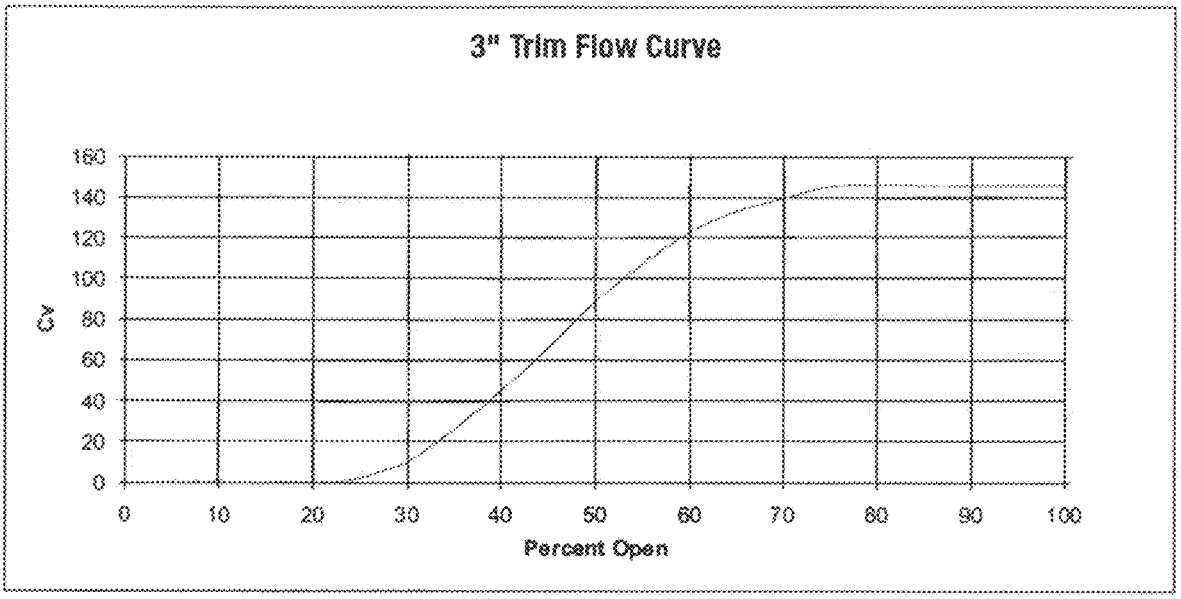
FIG. 5 illustrates a graph of flow coefficient ("Cv") values versus choke valve open position values for a prior art three-inch choke valve.

Referring to FIGS. 2-5, the valve position of the choke valve 34, measured by the valve position sensor 94, may be used to determine a volumetric flow rate Q of the fluid through the choke valve 34 (Step 1010 of Method 1000). As shown in FIG. 5 for a conventional 3-inch choke valve, a flow coefficient Cv value for the choke valve 34 may correspond to a particular valve position of the choke valve 34. For example, a choke valve 34 which is 50% percent open may have a known flow coefficient Cv value which corresponds to that choke valve 34 position. The flow coefficient Cv is a dimensionless variable that relates flow rate of a choke valve (e.g., the choke valve 34) to the differential pressure across the valve. In general, the relationship between the flow coefficient Cv of a choke valve and the valve position of the choke valve is typically unique to that particular model choke valve. The flow coefficient Cv values corresponding to valve position, for a particular choke valve, may be predetermined values known from testing (e.g, laboratory testing) the particular choke valve.

Using the flow coefficient Cv as well as differential pressure DP and specific gravity SG values of the return fluid flowing through the choke valve 34, a volumetric flow rate Q of the return fluid through the choke valve 34 may be determined using the following equation:

$$Q = \frac{Cv\sqrt{DP}}{\sqrt{SG}} \qquad \text{Eqn. 1}$$

The flow rate Q of the return fluid through the choke valve 34 may be determined by the controller 54, for example, with differential pressure DP and/or specific gravity SG values determined based on inputs from one or more of the pressure sensors 36, 38 and the density sensor 40. The flow rate Q through the choke valve 34, determined by the controller 54, may be used by the controller 54 for control and operation of the drilling system 10 (e.g., to control a valve position of the choke valve 34 to obtain a desired flow rate Q through the choke valve 34).

The known flow coefficient Cv values for the choke valve 34 may be included in one or more flow coefficient lookup tables stored by the controller 54. The one or more flow coefficient lookup tables may each include a plurality of flow coefficient Cv values corresponding to valve positions of the choke valve 34 along the total range of choke valve 34 positions (i.e., between 0 percent and 100 percent). For example, determining the flow rate Q of the return fluid based on the valve position of the choke valve 34 may include referencing a flow coefficient lookup table including a flow coefficient Cv value corresponding to the determined valve position of the choke valve 34. In various embodiments, the controller 54 may be programmed to calculate an updated flow coefficient Cv value for a determined position of the choke valve 34 and to replace the flow coefficient Cv value of the flow coefficient lookup table with the updated flow coefficient Cv value. The updated flow coefficient Cv value may be calculated, for example, by comparing an actual pressure response of the wellbore 18 provided by a pressure sensor (e.g., the pressure sensor 36), in response to the flow rate of the supply fluid and the flow rate Q of the return fluid, to an expected pressure response of the wellbore 18, based on the flow rate of the supply fluid and the flow rate Q of the return fluid.

Referring again to FIGS. 1, 2, and 10, in various embodiments, the drilling system 10 may include a fluid flow sensor 96 disposed in the fluid supply line 30 or the drill assembly 12 and configured to measure a flow rate of the supply fluid injected into the wellbore 18 by the drilling system 10 (Step 1008 of Method 1000). In various embodiments, the fluid flow sensor 96 may be a Coriolis flowmeter, however, it should be understood that the fluid flow sensor 96 may be any suitable sensor for measuring the flow rate of the supply fluid. For example, in various embodiments, the fluid flow sensor 96 may be a stroke sensor for the mud pump 26. The fluid flow sensor 96 may be in signal communication with the controller 54.

In various embodiments, the controller 54 may be programmed to detect one or more fluid excursions within the wellbore 18 based on a comparison of the measured flow rate Q of the return fluid and the flow rate of the supply fluid provided by the fluid flow sensor 96 (Step 1012 of Method 1000). The one or more fluid excursions may include, for example, a "kick" or a "loss of fluid" in the wellbore 18. A "kick" may occur when a pressure found within the drilled rock formation is higher than the pressure of the fluid within the wellbore 18. This pressure difference may tend to force rock formation fluids into the wellbore 18, thereby causing an increase in the flow rate Q of the return fluid compared to the flow rate of the supply fluid. A "loss of fluid" to the rock formations may occur when a pressure found within the drilled rock formation is lower than the pressure of the fluid within the wellbore 18. This pressure difference may tend to force fluids within the wellbore 18 into the rock formation, thereby causing a decrease in the flow rate Q of the return fluid compared to the flow rate of the supply fluid.

In various embodiments, the controller 54 may be programmed to adjust the valve position of the choke valve 34 in response to one or more parameters (Step 1014 of Method 1000). For example, the controller 54 may adjust the position of the choke valve 34 in response to the determined flow rate Q of the return fluid. In various embodiments, the controller 54 may adjust the position of the choke valve 34 to maintain the flow rate of the supply fluid and the flow rate Q of the return fluid substantially equal. For further example, in response to a detected kick, the controller 54 may close the choke valve 34 to increase backpressure in the fluid return line 24 (e.g., as measured by the pressure sensor 36), thereby increasing fluid pressure in the wellbore 18. For example, the controller 54 may adjust the choke valve 34 from a first open position to a second open position between the first open position and the fully-closed position. This process of increasing fluid pressure in the wellbore 18 may be referred to as "trapping." Similarly, in response to a detected loss of fluid, the controller 54 may open the choke valve 34 to reduce backpressure in the fluid return line 24, thereby reducing fluid pressure in the wellbore 18. For example, the controller 54 may adjust the choke valve 34 from a first open position to a second open position between the first open position and the fully-open position.

In various embodiments, the controller 54 may determine the multiphase fluid characteristics of the return fluid based on the calculated specific gravity SG of the return fluid provided by the first density sensor 38. The multiphase characteristics of the return fluid may have a significant effect on the specific gravity SG of the return fluid and, therefore, may affect the calculation of the volumetric flow rate Q of the return fluid based on Eqn. 1, as previously discussed. A sudden change in the multiphase fluid characteristics of the return fluid (e.g., a significant change in the gas or solid content of the return fluid) may also provide an additional indication that a kick has occurred in the wellbore 18. Accordingly, in various embodiments, the controller 54 may determine the multiphase fluid characteristics of the return fluid indicate that a kick has occurred based on a difference between the measured specific gravities of the return fluid and the supply fluid, which exceeds a threshold specific gravity value. The threshold specific gravity value may, for example, be specific to the particular type of formation being drilled.

Referring again to FIG. 5, it can be seen that the illustrated flow coefficient Cv for the conventional 3-inch choke valve includes portions having substantially constant Cv values over a range of valve positions. For example, the flow coefficient Cv may be substantially constant for valve positions between approximately 0-25 percent open and between approximately 75-100 percent open. For these ranges of valve positions wherein the flow coefficient Cv is substantially constant, calculation of the flow rate Q for the return fluid may be less accurate than a range of valve positions (i.e., an "accuracy range") wherein the flow coefficient Cv changes appreciably with a corresponding change in valve position of the choke valve 34. For example, the accuracy range of valve positions of the choke valve 34 between approximately 30 percent and 70 percent may provide a more accurate measurement of the flow rate Q relative to the valve positions of the choke valve 34 between approximately 0-25 percent open and between approximately 75-100 percent open. As used herein, the term "approximately," means the stated percentage value +/−5 percent.

In various embodiments, the controller 54 may be programmed to maintain the position of the choke valve 34 in the accuracy range of a total position range (i.e., 0-100 percent open) of the choke valve 34. For example, the controller 54 may be programmed to maintain the position of the choke valve in a position range of between 30 percent and 70 percent open of the total position range of the choke valve while the supply fluid is injected into the wellbore 18. As a person of skill in the art will recognize, the valve positions associated with the accuracy range will depend on the particular choke valve 34 which is selected for use in the choke system 32.

Referring to FIGS. 6A and 6B, in various embodiments, an exemplary adjustable choke valve 57 may alternatively be used in place of the choke valve 34 for the choke system 32. The choke valve 57 may have improved flow characteristics relative to the conventional choke valve 34 which may provide improved accuracy in the measurement of the flow rate Q as well as improved control of wellbore 18 fluid pressure. The choke valve 57 may include a body 58, a seat 60, a linearly translatable gate 62, and a nose 64. The body 58 may include an inlet flow passage 66, an outlet flow passage 68, and an internal chamber 70. The inlet flow passage 66 may extend from an external surface of the body 58 to the internal chamber 70. In the embodiment shown in FIGS. 6A and 6B, the external surface having the entry to the inlet flow passage 66 is different from the external surface having the exit of the outlet flow passage 68; e.g., the inlet flow passage 66 and the outlet flow passage 68 are oriented at 90° relative to one another. However, the present disclosure is not limited to this body 58 configuration.

The gate 62 is linearly translatable between a first position (i.e., a "fully closed" position) where zero fluid flow (0% flow) is permitted between the inlet flow passage 66 and the outlet flow passage 68 (shown in FIG. 6A), and a second position (i.e., a "fully open" position) where a maximum fluid flow (100% flow) is permitted between the inlet flow passage 66 and the outlet flow passage 68 (shown in FIG. 6B), and a continuum of positions there between.

Figure 8:
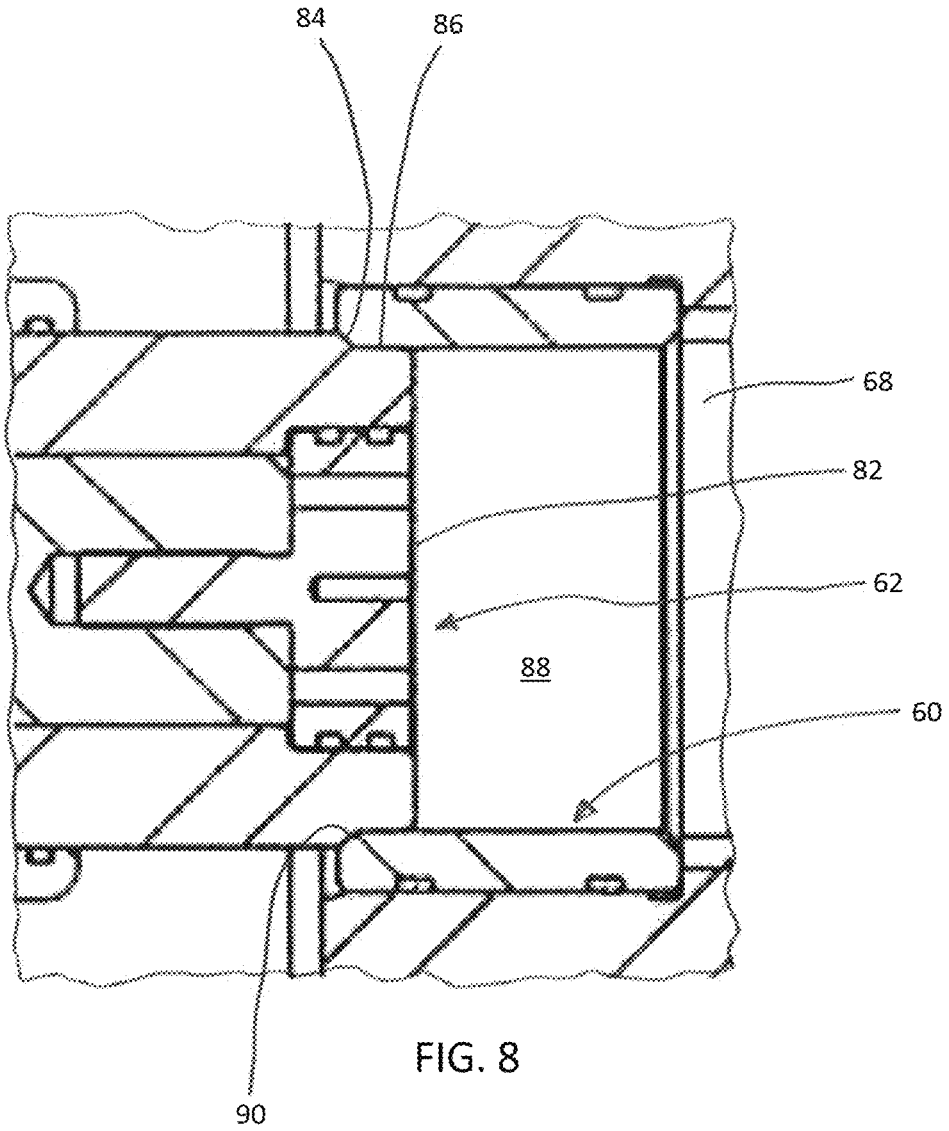
FIG. 8 illustrates an enlarged view of a portion of the choke valve of FIG. 6A, in accordance with one or more embodiments of the present disclosure.

Referring to FIGS. 6A, 6B, and 8, the gate 62 may include a gate shaft 72 and a gate body 74. The gate shaft 72 has a first end 76 and a distal second end 78. The first end 76 of the gate shaft 72 may be connected to the output shaft 56 of the worm gear drive 44 and the second end 78 of the gate shaft 72 may be connected to the gate body 74. The gate body 74 may include a first end 80, an opposite second end 82, and at least one seal surface 84. In the specific gate 62 embodiment shown in FIGS. 6A and 6B, the gate body 74 includes a metering segment 86 extending from the second end 82 to the seal surface 84. The gate 62 may be aligned with the seat 60, and may also be aligned with at least a portion of the outlet flow passage 68.

The seat 60 may be disposed at an end of the outlet flow passage 68 that is contiguous with the internal chamber 70. The seat 60 may include a central seat orifice 88 having a diameter and at least one seal surface 90 disposed at a first end of the seat orifice 88. The diameter of the seat orifice 88 may be greater than a diameter of the metering segment 86. In the embodiment shown in FIGS. 6A and 6B, the seat 60 has a cylindrical configuration and is positionally fixed within a bore disposed within the body 58 of the choke valve 57.

Figure 9:
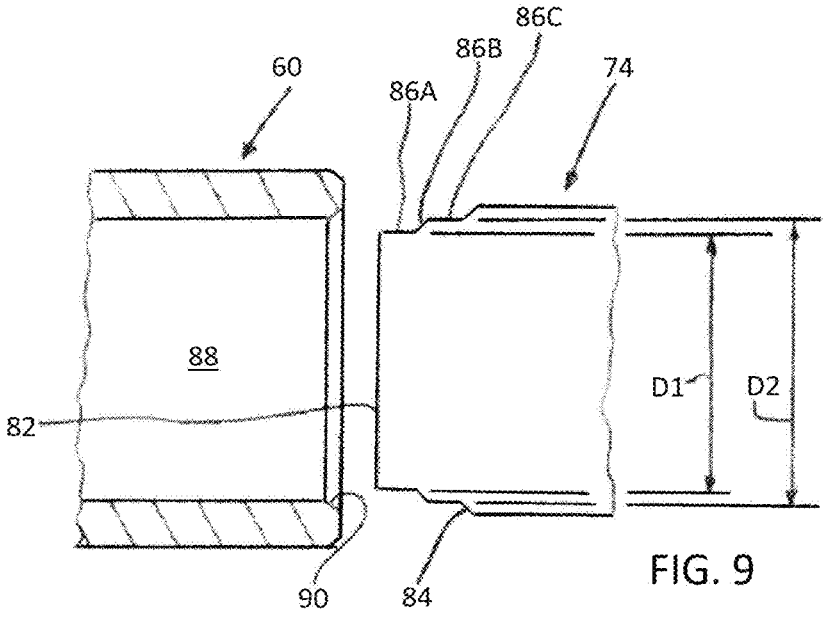
FIG. 9 illustrates a diagrammatic view of a gate body having a plurality of metering segments and a seat, in accordance with one or more embodiments of the present disclosure.
Figure 9A:
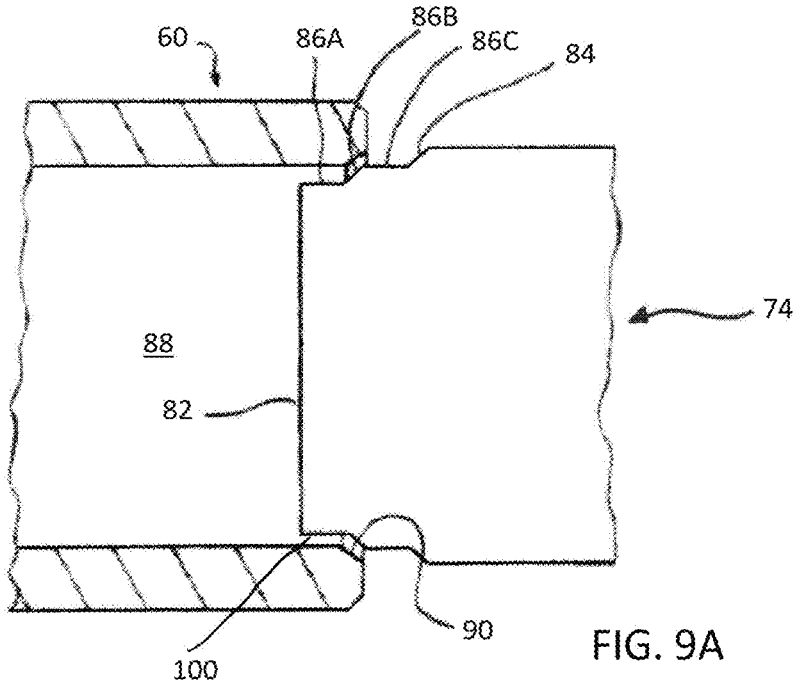
FIG. 9A-C illustrate diagrammatic views of the gate body of FIG. 9 with progressively increased engagement of the gate body with the seat, in accordance with one or more embodiments of the present disclosure.
Figure 9B:
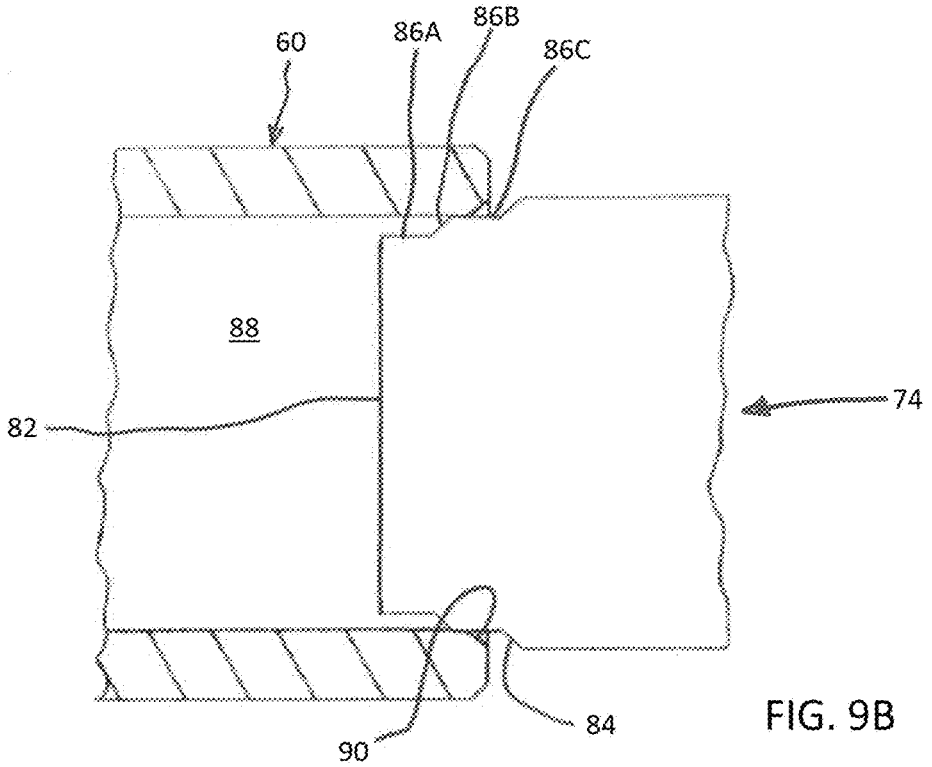
Figure 9C:
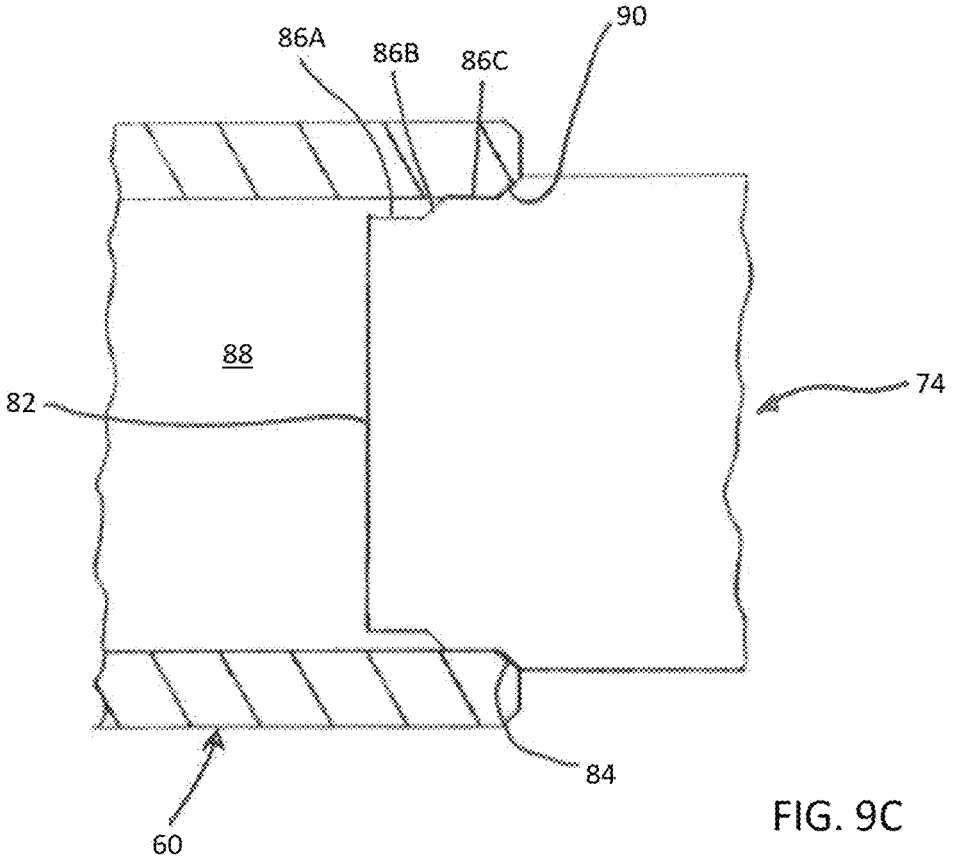

In the gate 62 embodiment shown in FIGS. 6A and 8, the choke valve 57 is shown in a "fully closed" position (described below), wherein the metering segment 86 is received within the seat orifice 88 and the seal surface 84 of the gate body 74 is engaged with the seal surface 90 of the seat 60. FIG. 10 illustrates an alternative gate body configuration that includes a plurality of metering segments 86A, 86B, 86C disposed at the second end of the gate body. Specifically, the gate body 74 shown in FIG. 9 includes a first metering segment 86A having a first diameter D1, a second metering segment 86B, a third metering segment 86C having a second diameter D2, and the seal surface 84. The second metering segment 86B extends between the first and third metering segments 86A, 86C. The gate body 74 embodiment shown in FIG. 10 is a non-limiting example of a gate body 74 having a plurality of metering segments and the present disclosure is not, therefore, limited to this particular embodiment; e.g., there may be more than three metering segments, the metering segments may be arcuately shaped and blended together, etc. As will be described below, the plurality of metering segments 86A-86C can be configured to produce a predetermined fluid flow profile and concomitant Cv curve portion for the choke valve 57. FIGS. 9A-9C show the gate body 74 of FIG. 9 (i.e., with a plurality of metering segments 86A-86C) with progressively increased engagement of the gate body 74 with the seat 60.

The nose 64 is positionally fixed within the body 58 of the choke valve 57, with at least a portion of the nose 64 disposed within the internal chamber 70. The nose 64 includes an internal passage 92 configured to receive at least a portion of the gate body 74.

In the first position, the at least one seal surface 84 of the gate body 74 is engaged with the seal surface 90 of the seat 60, thereby prohibiting fluid flow into the seat 60 and the outlet flow passage 68. In the second position, the at least one seal surface 84 of the gate body 74 is disengaged with and spaced apart from the seat 60, thereby permitting fluid flow into the seat 60 and the outlet flow passage 68.

As previously discussed, the gate 62 is linearly translatable between a first position (i.e., a "fully closed" position) where zero fluid flow (0% flow) is permitted between the inlet flow passage 66 and the outlet flow passage 68 (see FIG. 6A), and a second position (i.e., a "fully open" position) where a maximum fluid flow (100% flow) is permitted between the inlet flow passage 66 and the outlet flow passage 68 (see FIG. 6B), and a continuum of positions there between. In the first position, the at least one seal surface 84 of the gate body 74 is engaged with the seat seal surface 90, thereby prohibiting fluid flow into the seat 60 and the outlet flow passage 68. In the second position, the at least one seal surface 84 of the gate body 74 is disengaged with and spaced apart from the seat 60, thereby permitting fluid flow into the seat 60 and the outlet flow passage 68.

In any valve position wherein the choke valve 57 is at least partially open (e.g., 70% open, 40% open, 10% open, etc.), the fluid flow passing through the choke valve 57 must pass through a passage area that is a minimum area ("choke minimum passage area"), and that choke minimum passage area is defined by the specific configuration of that particular choke valve 57. For example, the choke minimum passage area may be defined by factors such as the position of the gate body 74 relative to the seat 60, the configuration of the gate body 74, the configuration of the internal chamber 70 in proximity to the seat 60, etc. Of course, in a fully closed position, the choke minimum passage area is zero.

In the prior art choke valves of which we are aware, when the choke valve is in a fully open position the choke minimum passage area is in the range of approximately 15-20% of the orifice area of the choke seat. For example, a three-inch cylindrical seat has an orifice area: $A=\Pi r^2=\Pi(1.5\text{ in})^2=7.068\text{ in}^2$). Hence, in the prior art choke valves of which we are aware having a three-inch seat, when the choke valve is in a fully open position, the choke minimum passage area is in the range of about 15-20% of 7.068 $\text{in}^2$ (i.e., 1.06 $\text{in}^2$-1.41 $\text{in}^2$). As can be seen, therefore, the fluid flow through a choke valve having a three-inch seat is affected by the choke minimum passage area more so than the diameter of the seat orifice. The choke minimum passage area has a direct effect on the size of debris that can pass through the choke valve and the fluid flow pressure drop across the choke valve. The pressure drop across the choke, in turn affects the Cv curve of the choke valve.

Embodiments of the choke valve 57 provide a solution that permits a greater volumetric flow rate Q through the choke valve 57 with a relative decrease in pressure difference across the choke valve 57 (e.g., for a given flow rate, the pressure difference across the choke valve 57 is less in conventional choke valves). Embodiments of the choke valve 57 include an increased gate stroke relative to prior art choke valves of which we are aware, while at the same time satisfying the requirements of the American Petroleum Institute ("API") 16C specification ("Choke and Kill Equipment") for choke closure time (i.e., the maximum permissible amount of time to go from 100% open to 0% open; e.g., 30 seconds), and/or similar industry standards as applicable. In various embodiments of the choke valve 57, the gate stroke (i.e., the linear distance travelled between the fully open position and the fully closed position) is in the range of about 1.2X-2.0X, where X is a gate stroke of a conventional choke valve. The increase in gate stroke within the choke valve 57 permits the gate 62 to linearly move further away from the seat 60, thereby increasing the choke minimum passage area. In various embodiments, the choke valve 57 in a fully open position has a choke minimum passage area in the range of up to 100% of the seat orifice 88 area, and preferably in the range of approximately 30-70% of the seat orifice 88 area, which is significantly greater than is possible with prior art choke valves of which we are aware. Using the cylindrical three-inch seat orifice 88 example from above, the choke minimum passage area is in the range of about 2.12 $in^2$-4.24 $in^2$ as compared to the 1.06 $in^2$-1.41 $in^2$ possible with the prior art chokes.

Figure 7:
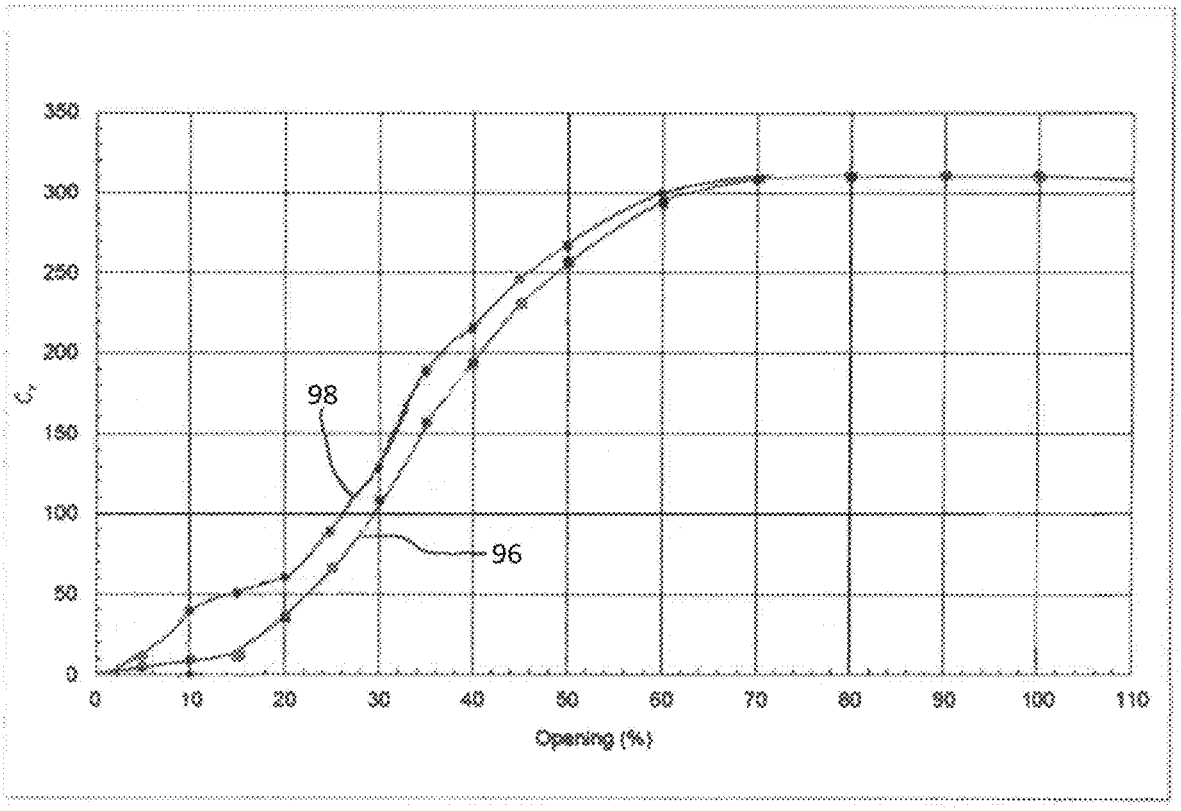
FIG. 7 illustrates an exemplary graph of flow coefficient ("Cv") values versus choke valve open position values for a three-inch choke valve, in accordance with one or more embodiments of the present disclosure.

Referring to FIGS. 5 and 7, the ability to accommodate a much higher volumetric flow rate Q through the choke valve 57 (which choke valve 57 has the same maximum pressure difference capacity as a comparable prior art choke valve), relative to prior art choke valves of which we are aware, greatly improves the controllability of the choke valve 57 improving control of wellbore 18 fluid pressure during both normal drilling operations and in response to wellbore fluid excursions. In contrast to the flow coefficient Cv curve illustrated in FIG. 5 for a conventional choke valve, consider a choke valve characterized by a flow coefficient Cv, such as the flow coefficient Cv curves 102, 104 shown in FIG. 7. Each of these flow coefficient Cv curves 102, 104 are defined by data intersection points in a graph (e.g., as shown in FIG. 7) having flow coefficient Cv values along a Y axis and choke open percentage values along an X axis. Both flow coefficient Cv curves 102, 104 in FIG. 7 characterize a choke valve 57 with a three-inch seat orifice similar to that associated with the flow coefficient Cv curve illustrated in FIG. 5, except the flow coefficient Cv curves in FIG. 7 are for a choke valve 57 with an increased gate stroke according to the present disclosure. The increased volumetric flow rate Q through the choke valve 57 may additionally allow a reduction in the number of choke valves which must be used for controlling wellbore 18 fluid pressure.

The first flow coefficient Cv curve 102 reflects data associated with a gate body 74 configured like that shown in FIGS. 6A, 6B, and 8; e.g., a gate body 74 having a single metering segment 86. The first flow coefficient Cv curve 102 includes a shallow sloped portion (between flow coefficient Cv values of about 0-15), a more steeply sloped portion between flow coefficient Cv values of about 10-300), a flat portion (at a flow coefficient Cv value of about 310), and a maximum flow coefficient Cv value of about 310. The maximum flow coefficient Cv value (310) for this embodiment of the present disclosure choke valve 57 represents about a 75% increase in the maximum flow coefficient Cv value over the similar sized prior art choke valve. Hence, this present disclosure choke valve 57 embodiment has a flow coefficient Cv sloped portion between the origin of the curve and a flow coefficient Cv value of about 310 (i.e., a first shallow sloped portion, and a second more steeply sloped portion that is about twice the length of that associated with the conventional three-inch choke valve), and concomitant substantially improved controllability.

The second flow coefficient Cv curve 104 reflects data associated with a gate body 74 configured like that shown in FIGS. 9 and 9A-9C; e.g., a gate body 74 having a plurality of metering segments 86A, 86B, 86C, and wherein the gate body 74 and the seat 60 may be partially engaged and an annular passage 100 formed between the first metering segment 86A and the seat orifice 88. The second flow coefficient Cv curve 104 is similar to the first flow coefficient Cv curve 102 except in the about 0-20% open portion, the second flow coefficient Cv curve 104 has a slope greater than the shallow slope portion of the flow coefficient Cv curve 102, having flow coefficient Cv values from zero to about 60. Hence, the control valve 57 embodiment having a gate body 74 with a plurality of metering segments 86A, 86B, 86C provides increased controllability as the choke valve 57 approaches the fully closed position, which may be particularly useful when adjusting the position of the choke valve 57, for example, in response to a detected kick in the wellbore 18. As stated above, the present disclosure is not limited to any particular gate body 74 configuration; e.g., the plurality of metering segments portion of the gate body 74 can be configured to produce a particular fluid flow profile and concomitant flow coefficient Cv curve portion which is suitable a given choke valve 57 application.

As shown in FIG. 7, the flow coefficient curves 102, 104 may be sloped from an origin of the respective flow coefficient curves 102, 104 to at least a sixty-percent open valve position of the choke valve 57. Accordingly, an accuracy range of valve positions for the choke valve 57 may be substantially greater than the accuracy range of valve positions discussed above with respect to the choke valve 34 (see FIG. 5). Further, the accuracy range of the flow coefficient curves 102, 104 for the choke valve 57 encompasses a broader range of flow coefficient Cv values compared to the choke valve 34, thereby providing a broader flow rate Q range which can be accommodated by the choke valve 57 while providing accurate measurement of the flow rate Q based on the valve position of the choke valve 57. Similar to the choke valve control discussed above with respect to the choke valve 34, in various embodiments, the controller 54 may be programmed to maintain the position of the choke valve 57 in the accuracy range of a total position range (i.e., 0-100 percent open) of the choke valve 57. For example, the controller 54 may be programmed to maintain the position of the choke valve 57 in a position range of between 0 percent and 60 percent open of the total position range of the choke valve 57 while the supply fluid is injected into the wellbore 18. The extension of the accuracy range of the choke valve 57 to lower flow valve positions (e.g., 0-10 percent open) may significantly improve the accuracy of flow rate Q measurements and controllability of the choke valve 57 at relatively low return fluid flow rates.

The detailed description of various embodiments herein makes reference to the accompanying drawings, which show various embodiments by way of illustration. While these various embodiments are described in sufficient detail to enable those skilled in the art to practice the inventions, it should be understood that other embodiments may be realized and that logical, chemical and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented.

Further, any reference to singular includes plural embodiments, and any reference to more than one component or step may include a singular embodiment or step. Also, any reference to attached, fixed, connected or the like may include permanent, removable, temporary, partial, full and/or any other possible attachment option. Any reference to without contact (or similar phrases) may also include reduced contact or minimal contact. Further still, all ranges disclosed herein are inclusive of the endpoints.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A drilling system comprising:

a choke valve system in fluid communication with a wellbore via a fluid return line, the choke valve system configured to receive a return fluid from the wellbore, the choke valve system comprising:

a choke valve through which the return fluid flows; and a valve position sensor configured to determine a position of the choke valve;

a controller in signal communication with the valve position sensor, the controller programmed to:

determine a flow rate of the return fluid through the fluid return line based on the determined position of the choke valve; and adjust the position of the choke valve in response to the determined flow rate of the return fluid;

wherein the choke valve comprises:

a body having an internal chamber, an inlet flow passage that extends between an exterior of the body and the internal chamber, and an outlet flow passage that extends between the exterior of the body and the internal chamber;

a seat having a seat orifice with an area, the seat positioned at an end of the outlet flow passage contiguous with the internal chamber;

a gate having a gate shaft and a gate body affixed to one end of the gate shaft;

wherein the gate body includes:

a first metering segment having a constant first diameter extending a first axial length along a translation axis, a second metering segment extending between the first metering segment and a third metering segment, the second metering segment having a second axial length, the third metering segment extending between the second metering segment and a seal surface, the third metering segment having a constant second diameter extending a third axial length, wherein the second diameter is larger than the first diameter, and the seal surface extending from the third metering segment, wherein portions of the seal surface have a diameter larger than the second diameter;

wherein the gate is linearly translatable within the body between a fully open position and a fully closed position, wherein in the fully closed position the seal surface of the gate body is engaged with the seat orifice; and wherein in the fully open position a choke minimum passage area is defined between the gate body and the seat orifice, and the choke minimum passage area is at least 30 percent of the area of the seat orifice.

2. A drilling system comprising:

a drill assembly in fluid communication with a fluid supply line and a wellbore, the drill assembly configured to receive a first fluid from the fluid supply line and inject the first fluid into the wellbore;

a choke manifold comprising a choke valve system in fluid communication with the wellbore via a fluid return line, the choke valve system configured to receive a second fluid from the wellbore, the choke valve system comprising:

a choke valve through which the second fluid flows; and a valve position sensor configured to determine a position of the choke valve; a flow sensor in fluid communication with the fluid supply line and configured to determine a first flow rate of the first fluid through the fluid supply line; and a controller in signal communication with the valve position sensor and the flow sensor, the controller programmed to:

determine a second flow rate of the second fluid through the fluid return line based on the position of the choke valve;

detect a kick or a loss of fluid in the wellbore based on the first flow rate and the second flow rate; and adjust the position of the choke valve in response to the detected kick or loss of fluid in the wellbore;

wherein the choke valve comprises:

a body having an internal chamber, an inlet flow passage that extends between an exterior of the body and the internal chamber, and an outlet flow passage that extends between the exterior of the body and the internal chamber;

a seat having a seat orifice with an area, the seat positioned at an end of the outlet flow passage contiguous with the internal chamber;

a gate having a gate shaft and a gate body affixed to one end of the gate shaft, wherein the gate body includes:

a first metering segment having a constant first diameter extending a first axial length along a translation axis, a second metering segment extending between the first metering segment and a third metering segment, the second metering segment having a second axial length, the third metering segment extending between the second metering segment and a seal surface, the third metering segment having a constant second diameter extending a third axial length, wherein the second diameter is larger than the first diameter, and the seal surface extending from the third metering segment, wherein portions of the seal surface have a diameter larger than the second diameter;

wherein the gate is linearly translatable within the body between a fully open position and a fully closed position, wherein in the fully closed position the seal surface of the gate body is engaged with the seat orifice; and wherein in the fully open position a choke minimum passage area is defined between the gate body and the seat orifice, and the choke minimum passage area is at least 30 percent of the area of the seat orifice.

3. The drilling system of claim 2, wherein the choke manifold further comprises at least one pressure sensor.

4. The drilling system of claim 3, wherein the at least one pressure sensor comprises a first pressure sensor upstream of the choke valve and a second pressure sensor downstream of the choke valve.

5. The drilling system of claim 4, further comprising a first density sensor upstream of the choke valve and a second density sensor downstream of the choke valve.

6. The drilling system of claim 2, wherein the controller is further programmed to maintain the position of the choke valve in a position range of between 30 percent and 70 percent of a total position range of the choke valve while the first fluid is injected into the wellbore.

7. The drilling system of claim 2, wherein the choke minimum passage area is between 30 percent and 70 percent of the seat orifice area.

8. The drilling system of claim 2, wherein the choke valve manifold further comprises a second choke valve system comprising a second choke valve through which the second fluid flows.

9. A method for detecting a kick or a loss of fluid in a wellbore, the method comprising:

injecting a first fluid into a wellbore with a drill assembly in fluid communication with a fluid supply line and the wellbore;

receiving a second fluid from the wellbore with a choke valve system in fluid communication with the wellbore via a fluid return line, the choke valve system comprising a choke valve through which the second fluid flows;

determining a position of the choke valve with a valve position sensor of the choke valve system;

determining a first flow rate of the first fluid through the fluid supply line with a flow sensor in fluid communication with the fluid supply line;

determining a second flow rate of the second fluid through the fluid return line based on the position of the choke valve;

detecting a kick or a loss of fluid in the wellbore based on the first flow rate and the second flow rate; and adjusting the position of the choke valve in response to the detected kick or loss of fluid in the wellbore;

wherein the choke valve comprises:

a body having an internal chamber, an inlet flow passage that extends between an exterior of the body and the internal chamber, and an outlet flow passage that extends between the exterior of the body and the internal chamber;

a seat having a seat orifice with an area, the seat positioned at an end of the outlet flow passage contiguous with the internal chamber;

a gate having a gate shaft and a gate body affixed to one end of the gate shaft, wherein the gate body includes:

a first metering segment having a constant first diameter extending a first axial length along a translation axis, a second metering segment extending between the first metering segment and a third metering segment, the second metering segment having a second axial length, the third metering segment extending between the second metering segment and a seal surface, the third metering segment having a constant second diameter extending a third axial length, wherein the second diameter is larger than the first diameter, and the seal surface extending from the third metering segment, wherein portions of the seal surface have a diameter larger than the second diameter;

wherein the gate is linearly translatable within the body between a fully open position and a fully closed position, wherein in the fully closed position the seal surface of the gate body is engaged with the seat orifice; and wherein in the fully open position a choke minimum passage area is defined between the gate body and the seat orifice, and the choke minimum passage area is at least 30 percent of the area of the seat orifice.

10. The method of claim 9, further comprising determining a pressure of the second fluid with at least one pressure sensor of the choke valve system.

11. The method of claim 10, wherein the at least one pressure sensor comprises a first pressure sensor upstream of the choke valve and a second pressure sensor downstream of the choke valve.

12. The method of claim 11, further comprising determining a first density of the second fluid with a first density sensor upstream of the choke valve and determining a second density of the second fluid with a second density sensor downstream of the choke valve.

13. The method of claim 12, wherein the second fluid is a multi-phase fluid.

14. The method of claim 11, further comprising maintaining the position of the choke valve in a position range of between 30 percent and 70 percent of a total position range of the choke valve while the first fluid is injected into the wellbore.

15. The method of claim 9, further comprising maintaining the position of the choke valve in a position range of between 0 percent and 60 percent of a total position range of the choke valve while the first fluid is injected into the wellbore.

16. The method of claim 9, wherein determining the second flow rate of the second fluid through the fluid return line based on the position of the choke valve includes referencing a flow coefficient lookup table including a flow coefficient value corresponding to the determined position of the choke valve.

17. The method of claim 16, further comprising calculating an updated flow coefficient value for the determined position of the choke valve and replacing the flow coefficient value of the flow coefficient lookup table with the updated flow coefficient value.

* * * * *